US007059124B2

(12) United States Patent
Suzuki et al.

(10) Patent No.: US 7,059,124 B2
(45) Date of Patent: Jun. 13, 2006

(54) HYDRAULIC CONTROL APPARATUS FOR WORK MACHINES

(75) Inventors: Kazuyuki Suzuki, Hirakata (JP); Takeshi Takaura, Cambridge, MA (US)

(73) Assignee: Komatsu Ltd., Tokyo (JP)

( * ) Notice: Subject to any disclaimer, the term of this patent is extended or adjusted under 35 U.S.C. 154(b) by 49 days.

(21) Appl. No.: 11/000,405

(22) Filed: Dec. 1, 2004

(65) Prior Publication Data

US 2005/0205272 A1 Sep. 22, 2005

(30) Foreign Application Priority Data

Dec. 1, 2003 (JP) ..... 2003-401845

(51) Int. Cl.
*F16D 31/02* (2006.01)

(52) U.S. Cl. ..... 60/421; 60/422; 60/429; 91/515

(58) Field of Classification Search ..... 60/421, 60/422, 424, 427, 428, 429, 445, 446, 486; 91/515, 391
See application file for complete search history.

(56) References Cited

U.S. PATENT DOCUMENTS

| | | | | |
|---|---|---|---|---|
| 4,802,537 A | | 2/1989 | Ryerson | |
| 5,083,428 A | * | 1/1992 | Kubomoto et al. | 60/421 |
| 5,211,014 A | * | 5/1993 | Kropp | 60/421 |
| 5,481,872 A | * | 1/1996 | Karakama et al. | 60/421 |
| 5,799,737 A | | 9/1998 | Kamikawa et al. | |
| 5,970,709 A | * | 10/1999 | Tohji | 60/421 |
| 5,996,341 A | * | 12/1999 | Tohji | 60/421 |
| 6,170,261 B1 | * | 1/2001 | Ishizaki et al. | 60/421 |
| 6,481,506 B1 | | 11/2002 | Okada et al. | |

FOREIGN PATENT DOCUMENTS

| | | |
|---|---|---|
| JP | 5-288203 | 11/1993 |
| JP | 11-218102 | 8/1999 |
| JP | 11-236902 | 8/1999 |
| JP | 11-303808 | 11/1999 |

* cited by examiner

*Primary Examiner*—Igor Kershteyn
(74) *Attorney, Agent, or Firm*—Wenderoth, Lind & Ponack, L.L.P.

(57) ABSTRACT

A hydraulic control apparatus which is used in order to prevent the blade from falling over on the pitch back side during a dual tilting operation, and to operate the left and right tilting cylinders in a uniform manner even in case where there is a large difference in the load pressure between the left and right tilting cylinders. In cases where it is desired to perform a dual tilting operation, the operator moves the operating lever either leftward or rightward while pressing the dual tilting switch of the operating lever. As a result of the switch being pressed, an electrical control signal that places the flow-combining/flow-dividing switching valve or flow-combining/flow-dividing valve in the flow-dividing position is generated by the controller, and the electrical control signal is output to the flow-combining/flow-dividing switching valve so that the flow-combining/flow-dividing switching valve or flow-combining/flow-dividing valve is switched to the flow-dividing position.

5 Claims, 6 Drawing Sheets

HYDRAULIC CONTROL APPARATUS FOR WORK MACHINES

BACKGROUND OF THE INVENTION

1. Field of the Invention

The present invention relates to a hydraulic control apparatus for work machines, and more particularly relates to a hydraulic control apparatus used in a work machine equipped with a dozing blade that has left and right hydraulic cylinders used for tilting, such as bulldozers and the like.

2. Description of the Related Art (Conventional Art 1)

FIG. 2 shows the peripheral parts of the blade installed on the front part of the vehicle body of a bulldozer in a perspective view.

Bulldozers perform work such as digging and transporting earth, and leveling the ground surface following such excavation by means of a blade 3 (dozing blade) that is attached to the front part of the vehicle main body.

A pair of tilting cylinders, i. e., left and right tilting cylinders 4 and 5, are installed between the blade 3 and vehicle main body.

If both of the tilting cylinders 4 and 5 are simultaneously driven in the same direction (in extension or retraction), the blade 3 is placed in a pitch dump attitude (forward-inclined attitude) or pitch back attitude (rearward-inclined attitude).

Furthermore, if one of the tilting cylinders is placed in stopped state, and the other tilting cylinder is driven in extension or retraction, the blade 3 assumes an attitude in which the right end part or left end part of the blade 3 is tilted downward (right-tilted attitude or left-tilted attitude). This is called a single tilting operation. The performance of a single tilting operation is described in U.S. Pat. No. 5,799,737.

Furthermore, if one of the tilting cylinders is driven in extension or retraction at the same time that the other tilting cylinder is driven in extension or retraction, the operation speed of the tilting operation of the blade 3 is increased. This is called a dual tilting operation. The performance of a dual tilting operation is described in U.S. Pat. No. 4,802,537 and U.S. Pat. No. 6,481,506.

(Conventional Art 2)

FIG. 5A shows the hydraulic circuit in a case where two fixed displacement hydraulic pumps 105 and 104 are used as a pressurize oil supply source for the left and right tilting cylinders 103 and 102.

As is shown in FIG. 5A, left and right tilting cylinders 103 and 102 are attached to the blade 101. Fixed displacement hydraulic pumps 105 and 104 are installed corresponding to the left and right tilting cylinders 103 and 102; furthermore, main operating valves 107 and 106 in which the direction and flow rate of the pressurized oil are controlled are installed respectively corresponding to the left and right cylinders 103 and 102.

The pressurized oil that is discharged from the fixed displacement hydraulic pump 105 is supplied to the bottom end chamber 103B or head end oil chamber 103H of the left tilting cylinder 103 via the main operating valve 107. Similarly, the pressurized oil that is discharged from the fixed displacement hydraulic pump 104 is supplied to the bottom end chamber 102B or head end chamber 102H of the right tilting cylinder 102 via the main operating valve 106.

(Conventional Art 3)

FIG. 6 shows the hydraulic circuit 110 in a case where a single variable displacement type hydraulic pump 111 is used as the pressurized oil supply source of the left and right tilting cylinders 103 and 102.

In order to prevent the construction of the hydraulic circuit from becoming complicated, the main operating valves 107 and 105 are connected in parallel to a single variable displacement hydraulic pump 111.

Specifically, as is shown in FIG. 6, left and right tilting cylinders 103 and 102 are attached to the blade 101. Main operating valves 107 and 106 in which the direction and flow rate of the pressurized oil are controlled are installed corresponding to the left and right tilting cylinders 103 and 102. The discharge port of the variable displacement hydraulic pump 111 is caused to communicate with the inlet port of the main operating valve 107 via a pressure compensating valve 113, and is caused to communicate with the inlet port of the main operating valve 106 via a pressure compensating valve 112.

If the system is devised so that left and right tilting cylinders 103 and 102 are simultaneously driven by the single variable displacement hydraulic pump 111 without pressure compensating valves 113 and 112, even if the opening areas of the main operating valves 107 and 106 are varied by the same amount by operating the operating levers, a large flow rate will be supplied on the side of the tilting cylinder with a smaller load (e. g., the left tilting cylinder 103), and only a small flow rate will be supplied on the side of the tilting cylinder with a larger load (e. g., the tilting cylinder 102).

Accordingly, pressure compensating valves 113 and 112 are installed for the respective main operating valves 107 and 106 so that flow rates corresponding to the amounts of operation of the operating levers are supplied to the left and right tilting cylinders 103 and 102 without being affected by the load.

Hydraulic pressure compensation is accomplished by the installation of the pressure compensating valves 113 and 112. As a result, the differential pressure before and after the constriction on the side with a light load, e. g., the main operating valve 107, is the same value as the differential pressure before and after the constriction of the main operating valve 106 on the side with a heavy load.

As a result of pressure compensation thus being performed, the differential pressures before and after the constrictions of both main operating valves 107 and 106 are the same value so that flow rates proportional to the degrees of opening of the main operating valves 107 and 106, i. e., proportional to the amounts of operation of the operating levers, are supplied to the tilting cylinders 103 and 102 without being affected by the load.

SUMMARY OF THE INVENTION

A phenomenon in which the blade 101 falls over on the pitch back side occurs when a dual tilting operation is performed using the hydraulic circuit 100 described in the abovementioned Conventional art 2 (FIG. 5A).

FIG. 5B shows how the stroke positions of the left and right tilting cylinders 103 and 102 shown in FIG. 5A vary.

Specifically, between the bottom end oil chambers 103B and 102B and head end oil chambers 103H and 102H of the left and right tilting cylinders 103 and 102, the cross-sectional areas of the head end oil chambers 103H and 102H are smaller than the cross-sectional areas of the bottom end oil chambers 103B and 102B by an amount equal to the piston rods 103*a* and 102*a*, so that a difference in cross-sectional area exists between the two oil compartments. Furthermore, in the case of the hydraulic circuit shown in FIG. 5A, since fixed displacement hydraulic pumps 105 and 104 are used, if the opening areas of the main operating valves 107 and 106 are the same, then the supplied flow rates are the same when pressurized oil is supplied to the bottom end oil chambers 103B and 102B and when pressurized oil is supplied to the head end oil chambers 103H and 102H.

In the case of a dual tilting operation, pressurized oil is supplied to the bottom end oil chamber of one tilting cylinder of the left and right tilting cylinders 103 and 102, and pressurized oil is supplied to the head end oil chamber of the other tilting cylinder.

Accordingly, from a state in which the stroke positions of the left and right tilting cylinders 103 and 102 are respectively the initial positions L0 and R0, when the same flow rate is supplied from the fixed displacement hydraulic pumps 105 and 104 so that the left tilting cylinder 103 is driven in the direction of retraction, and the right tilting cylinder 102 is simultaneously driven in the direction of extension, the piston rod 103*a* of the left tilting cylinder 103 moves by a stroke P in the direction of retraction from the initial position L0 and reaches the position L1, but the piston rod 102*a* of the right tilting cylinder 102 moves by a stroke Q which is smaller than the stroke P (Q<P) in the direction of extension from the initial position R0, and reaches the position R1, as a result of the abovementioned cross-sectional area difference. Subsequently, in order to return the blade 101 to the initial positions L0 and R0, when the same flow rates are supplied to the left and right tilting cylinders 103 and 102 from the fixed displacement hydraulic pumps 105 and 104, and the left tilting cylinder 103 is driven in the direction of extension while the right tilting cylinder 102 is driven in the direction of retraction, the same cross-sectional area difference causes the piston rod 103*a* of the left tilting cylinder 103 to move by a stroke of Q in the direction of extension from the position L1 so that the piston rod 103*a* reaches the position L2, while the piston rod 102*a* of the right tilting cylinder 102 is caused to move by a stroke P which is larger than the stroke Q (P>Q) in the direction of retraction from the position R1, so that the piston rod 102*a* reaches the position R2.

As a result, the stroke positions of the left and right tilting cylinders 103 and 102 are shifted to the pitch back side of the blade 101 from the initial positions L0 and R0 by a stroke difference of (P−Q) between extension and retraction by a single dual tilting operation and return operation. In other words, the blade 101 falls over on the pitch back side. Furthermore, as a result of the repetition of a multiple number of dual tilting operations, the piston rods 103*a* and 102*a* reach the stroke end on the pitch back side of the blade 101, i. e., in the direction of retraction.

On the other hand, in cases where a dual tilting operation is performed using the hydraulic circuit 110 described in Conventional art 3 (FIG. 6), a phenomenon may occur in which the blade 101 tilt without returning to the initial position.

Specifically, in the case of a dual tilting operation, a difference in load pressure may be generated between the left and right tilting cylinders 103 and 102. Here, even if there is a difference in the load pressure, the same flow rates can be supplied to the left and right tilting cylinders 103 and 102 if the pressure compensation performed by the pressure compensating valves 103 and 102 is perfect.

However, if the difference in the load pressure between the left and right tilting cylinders 103 and 102 is large, a deviation in pressure compensation may occur so that the same flow rate cannot be supplied to the left and right tilting cylinders 103 and 102, thus making it impossible for the left and right tilting cylinders 103 and 102 to operate at a uniform speed. Accordingly, when a dual tilting operation is performed, the following problem arises: namely, the piston rods 103*a* and 102*a* of the left and right tilting cylinders 103 and 102 do not return to the same initial positions, so that the stroke positions deviate on the left and right, and the blade 101 tilts.

This is true not only in the case of a dual tilting operation, but also in cases where a pitch operation is performed.

If the difference in the load pressure between the left and right tilting cylinders 103 and 102 is large during a pitch operation, a deviation in pressure compensation may be generated, so that the same flow rates cannot be supplied to the left and right tilting cylinders 103 and 102, thus making it impossible for the left and right tilting cylinders 103 and 102 to operate at a uniform speed. Accordingly, when a pitch operation is performed, the following problem arises: namely, the piston rods 103*a* and 102*a* of the left and right tilting cylinders 103 and 102 do not reach the same stroke position, so that the blade 101 tilts.

The present invention was devised in light of the above facts; a first problem to be solved by the present invention is to prevent the blade from falling over on the pitch back side during a dual tilting operation, and to allow the left and right tilting cylinders to operate in a uniform manner even in cases where there is a large difference in the load pressure between the left and right tilting cylinders.

Furthermore, a second problem to be solved by the present invention is to allow the left and right tilting cylinders to operate in a uniform manner even in cases where there is a large difference in the load pressure between the left and right tilting cylinders during a pitch operation, so that tilting of the blade can be prevented.

In the case of a bulldozer, the abovementioned left and right tilting cylinders are installed for the blade, and left and right lifting cylinders are also installed. Furthermore, ripper lifting cylinders, ripper tilting cylinders and the like are also installed for the ripper on the rear end of the vehicle body.

When earthmoving work or the like is performed, the tilting cylinders and other hydraulic cylinders (lifting cylinders) are simultaneously driven (in a composite operation). In such a composite operation, it is necessary to improve the working efficiency of the composite operation of the plurality of hydraulic actuators by efficiently supplying pressurized oil from a pressurized oil supply source in accordance with the loads that are applied to the respective hydraulic cylinders.

The present invention was devised in light of such facts; in addition to the abovementioned first problem to be solved and second problem to be solved, a third problem that is to be solved by the present invention is to improve the working efficiency during the composite operation of a plurality of hydraulic actuators in a work machine such as a bulldozer or the like equipped with tilting cylinders.

The first aspect of the present invention comprises a blade that is attached to a vehicle main body so that the blade is capable of a tilting operation; first and second variable displacement hydraulic pumps; left and right tilting hydraulic cylinders that are attached to left and right of the blade, and that are driven by a supply of pressurized oil that is discharged from the first and second variable displacement hydraulic pumps; first and second main operating valves in which direction and flow rate of the pressurized oil that is supplied to the left and right tilting hydraulic cylinders are controlled; first and second discharge oil passages that connect discharge ports of the first and second variable displacement hydraulic pumps and the first and second main operating valves; first and second pressure compensating valves that compensate differential pressures before and after the first and second main operating valves to specified values; a first flow-combining/flow-dividing valve that switches between a flow-combining position that causes communication between the first discharge oil passage and second discharge oil passage, and a flow-dividing position that cuts off the communication between the first discharge oil passage and the second discharge oil passage; and control means for controlling the switching of the flow-combining/flow-dividing valve so that a switching action is performed in which the flow-combining/flow-dividing valve is switched from the flow-combining position to the flow-dividing position in cases where it is judged that a dual tilting operation is to be performed in which pressurized oil is supplied to a bottom end oil chamber of one of the tilting hydraulic cylinders among the left and right tilting hydraulic cylinders, and pressurized oil is supplied to a head end oil chamber of the other tilting hydraulic cylinder.

The second aspect of the present invention comprises a blade that is attached to the vehicle main body so that the blade is capable of a tilting operation; first and second variable displacement hydraulic pumps; left and right tilting hydraulic cylinders that are attached to left and right of the blade, and that are driven by a supply of pressurized oil that is discharged from the first and second variable displacement hydraulic pumps; first and second main operating valves in which direction and flow rate of the pressurized oil that is supplied to the left and right tilting hydraulic cylinders are controlled; first and second discharge oil passages that connect discharge ports of the first and second variable displacement hydraulic pumps and the first and second main operating valves; first and second pressure compensating valves that compensate differential pressures before and after the first and second main operating valves to specified values; a first flow-combining/flow-dividing valve which switches between a flow-combining position that causes communication between the first discharge oil passage and second discharge oil passage, and a flow-dividing position that cuts off the communication between the first discharge oil passage and the second discharge oil passage; and control means for controlling switching of the flow-combining/flow-dividing valve so that a switching action is performed in which the flow-combining/flow-dividing valve is switched from the flow-combining position to the flow-dividing position in cases where it is judged that a pitch operation is to be performed in which pressurized oil is supplied to one of the oil chambers among a bottom end oil chamber and a head end oil chamber for the left and right tilting hydraulic cylinders.

The third aspect of the present invention is the first aspect of the present invention which further comprises flow rates control means for controlling the flow rates that are supplied to the left and right tilting hydraulic cylinders so that the stroke on an extension side and stroke on a retraction side of the left and right tilting hydraulic cylinders are the same during a dual tilting operation.

The fourth aspect of the present invention is the first aspect of the present invention which further comprises hydraulic actuators for a work implement that are driven by the supply of pressurized oil that is discharged from the first and second variable displacement hydraulic pumps, other than the left and right tilting hydraulic cylinders, wherein the switching control means control the flow-combining/flow-dividing valve so that an operation is performed in which the flow-combining/flow-dividing valve is switched from the flow-dividing position to the flow-combining position in cases where it is judged that the hydraulic actuators for a work implement are to be driven simultaneously with the left and right tilting hydraulic cylinders.

The fifth aspect of the present invention is the second aspect of the present invention which further comprises hydraulic actuators for a work implement that are driven by the supply of pressurized oil that is discharged from the first and second variable displacement hydraulic pumps, other than the left and right tilting hydraulic cylinders, wherein the switching control means control the flow-combining/flow-dividing valve so that an operation is performed in which the flow-combining/flow-dividing valve is switched from the flow-dividing position to the flow-combining position in cases where it is judged that the hydraulic actuators for a work implement are to be driven simultaneously with the left and right tilting hydraulic cylinders.

The first aspect of the present invention and third aspect of the present invention will be concretely described with reference to the accompanying drawings. As shown in FIG. 3, in cases where it is desired to perform a dual tilting operation, the operator moves the operating lever 50 in either the leftward or rightward direction C or D while pressing the dual tilting switch 50*c*.

In a case where the abovementioned operation is performed in the hydraulic circuit shown in FIG. 1, the controller 53 generates an electrical control signal that is used to place a flow-combining/flow-dividing switching valve 18 in a flow-dividing position B as a result of the switch 50*c* being pressed. This electrical control signal is output to the flow-combining/flow-dividing switching valve 18, so that the flow-combining/flow-dividing switching valve 18 is switched to the flow-dividing position B, thus introducing pressurized oil from the oil passage 66 into the oil passages 61 and 62. An flow-combining/flow-dividing valve 17 is connected ahead of the oil passage 61, and flow-combining/flow-dividing valves 48 and 148 are connected ahead of the oil passage 62. When pressurized oil is introduced into the oil passages 61 and 62 from the oil passage 66, the flow-combining/flow-dividing valves 17, 48 and 148 are switched to the flow-dividing position B. Furthermore, in cases where an electrical control signal is not output from the controller 53, the flow-combining/flow-dividing switching valve 18 is in the flow-combining position A, the oil passages 61 and 62 communicate with the reservoir 55, and the flow-combining/flow-dividing valves 17, 48 and 148 are in the flow-combining position A.

As a result, the communicating passage 16 that connects the first hydraulic pump 6 and second hydraulic pump 7 is closed, so that the pressurized oil that is discharged from the first hydraulic pump 6 is discharged only into a first discharge oil passage 14, and the pressurized oil that is discharged from the second hydraulic pump 7 is discharged only into a second discharge oil passage 15.

Furthermore, a first load pressure detection oil passage 90 and a second load pressure detection oil passage 91 are cut off, and a first load pressure introduction oil passage 163 and a second load pressure introduction oil passage 164 (164') are cut off, so that pressure compensation is canceled. Specifically, an own load pressure is applied to the pressure receiving part of a first pressure compensating valve 9 via a first load pressure detection port 23, the first load pressure detection oil passage 90, the first load pressure introduction oil passage 163, and a shuttle valve 63. As a result, the load pressure on the outlet cylinder port side of the first main operating valve 8 maintains this own load pressure.

Meanwhile, an own load pressure is applied to the pressure receiving part of the second pressure compensating valve 12 via a second load pressure detection port 38, the second load pressure detection oil passage 91, the second load pressure introduction oil passage 164 (164'), and a shuttle valve 64. As a result, the load pressure on the outlet cylinder port side of the second main operating valve 11 maintains this own load pressure.

Thus, in the case of a dual tilting operation, the communicating passage 16 between the first hydraulic pump 6 and second hydraulic pump 7 is closed, and pressure compensation for the respective tilting cylinders 4 and 5 operates independently by the own load pressure. Accordingly, pressurized oil is independently supplied to the left and right tilting cylinders 4 and 5 from the first hydraulic pump 6 and second hydraulic pump 7.

Accordingly, the flow rates of the pressurized oil supplied to the left and right tilting cylinders 4 and 5 can be independently adjusted by the servomechanisms 71 and 72.

In the third aspect of the present invention, flow rate adjustment is performed as follows.

Specifically, in the controller 53, as a result of the dual tilting switch 50*c* being pressed, an electrical control signal that causes the stroke amounts of the tilting cylinders 4 and 5 during retraction and extension to be set at the same amount P is output to the servomechanisms 71 and 72, and the swash angles of the swash plates 6*a* and 7*a* of the first and second hydraulic pumps 6 and 7 are controlled so that the flow rates supplied to the respective tilting cylinders 4 and 5 are adjusted.

Referring also to FIG. 5B, in the case of the left tilting cylinder 4 (tilting cylinder 103 in FIG. 5B), pressurized oil at a specified flow rate of QH is supplied to the head end oil chamber 4*b* (head end oil chamber 103H in FIG. 5B) during retraction, so that the tilting cylinder moves by a stroke of P in the direction of retraction from the initial position L0, and reaches the position L1. Then, during the subsequent extension, pressurized oil at a flow rate of QB which is larger than the flow rate QH during retraction is supplied to the bottom end oil chamber 4*a* (bottom end oil chamber 103B in FIG. 5B), so that the tilting cylinder moves from the stroke position L1 in the direction of extension by the same stroke of P, and returns to the original initial position L0.

On the other hand, in the case of the right tilting cylinder 5 (tilting cylinder 102 in FIG. 5B), during extension, pressurized oil at a specified flow rate of QB is supplied to the bottom end oil chamber 5*a* (bottom end oil chamber 102B in FIG. 5B), so that the tilting cylinder moves in the direction of extension from the initial position R0 by a stroke of P, and thus reaches the stroke position R3. Then, during the subsequent retraction, pressurized oil at a flow rate QH that is smaller than the flow rate QB during extension is supplied to the head end oil chamber 5*b* (head end oil chamber 102H in FIG. 5B), so that the tilting cylinder moves by the same stroke of P in the direction of retraction from the stroke position R3, and returns to the original initial position R0.

As a result, in a single dual tilting operation, the stroke positions of the left and right tilting cylinders 4 and 5 maintain the original initial positions without any deviation to the pitch back side from the initial positions L0 and R0. In other words, a dual tilting operation can be performed without the blade 3 falling over on the pitch back side.

Furthermore, even if such a dual tilting operation is performed a multiple number of times, the piston rods do not reach the stroke end on the pitch back side of the blade 3, i.e., in the direction of retraction.

Furthermore, since pressure compensation is canceled, the inconvenience of a deviation in pressure compensation occurring in cases where the difference in the load pressure between the left and right tilting cylinders 4 and 5 is large so that the same flow rate cannot be supplied to the left and right tilting cylinders 4 and 5, thus making it impossible for the left and right tilting cylinders 4 and 5 to operate at a uniform speed, can be avoided. As a result, a state in which the piston rods of the left and right tilting cylinders 4 and 5 do not return to the initial positions in the case of a dual tilting operation can be prevented.

Next, the second aspect of the present invention will be described.

In cases where it is desired to perform a pitch operation, the operator moves the operating lever 50 in either the leftward or rightward direction C or D while pressing the pitch dump/pitch back switch 50*b* of the operating lever 50.

In case where the abovementioned operation is performed in the hydraulic circuit shown in FIG. 1, the controller 53 generates an electrical control signal that causes a switch to the flow-dividing position B as a result of the switch 50*b* being pressed. The electrical control signal is output to the flow-combining/flow-dividing switching valve 18, and the flow-combining/flow-dividing switching valve 18 is switched to the flow-dividing position B, so that pressurized oil from the oil passage 66 is introduced into the oil passages 61 and 62. A flow-combining/flow-dividing valve 17 is connected ahead of the oil passage 61, and flow-combining/flow-dividing valves 48 and 148 are connected ahead of the oil passage 62. When pressurized oil is introduced into the oil passages 61 and 62 from the oil passage 66, the flow-combining/flow-dividing valves 17, 48 and 148 are switched to the flow-dividing position B. Furthermore, in cases where no electrical control signal is output from the controller 53, the flow-combining/flow-dividing switching valve 18 is in the flow-combining position A, the oil passages 61 and 62 communicate with the reservoir 55, and the flow-combining/flow-dividing valves 17, 48 and 148 are in the flow-combining position A.

As a result, the communicating passage 16 that connects the first hydraulic pump 6 and second hydraulic pump 7 is closed, so that the pressurized oil that is discharged from the first hydraulic pump 6 is discharged only into a first discharge oil passage 14, and the pressurized oil that is discharged from the second hydraulic pump 7 is discharged only into a second discharge oil passage 15.

Furthermore, the first load pressure detection oil passage 90 and second load pressure detection oil passage 91 are cut off, and the first load pressure introduction oil passage 163 and second load pressure introduction oil passage 164 (164') are cut off, so that pressure compensation is canceled. Specifically, an own load pressure is applied to the pressure receiving part of a first pressure compensating valve 9 via the first load pressure detection port 23, the first load pressure detection oil passage 90, the first load pressure introduction oil passage 163, and shuttle valve 63. As a result, the load pressure on the outlet cylinder port side of the first main operating valve 8 maintains this own load pressure.

Meanwhile, an own load pressure is applied to the pressure receiving part of the second pressure compensating valve 12 via a second load pressure detection port 38, the second load pressure detection oil passage 91, the second load pressure introduction oil passage 164 (164'), and a shuttle valve 64. As a result, the load pressure on the outlet cylinder port side of the second main operating valve 11 maintains this own load pressure.

Thus, in a pitch back operation, the communicating passage 16 between the first hydraulic pump 6 and second hydraulic pump 7 is closed, and pressure compensation for the respective tilting cylinders 4 and 5 operates independently by the own load pressure. Accordingly, pressurized oil is independently supplied to the left and right tilting cylinders 4 and 5 from the first hydraulic pump 6 and second hydraulic pump 7.

Accordingly, since pressure compensation is performed in a pitch operation, it is possible to avoid the inconvenience of a deviation in pressure compensation occurring in cases where the difference in the load pressure between the left and right tilting cylinders 4 and 5 is large so that the same flow rate cannot be supplied to the left and right tilting cylinders 4 and 5, thus making it impossible for the left and right tilting cylinders 4 and 5 to operate at a uniform speed. As a result, a state in which the piston rods of the left and right tilting cylinders 4 and 5 do not reach the same stroke position so that the blade 3 tilts can be prevented.

Next, the fourth and fifth aspect of the present inventions will be described.

In the fourth and fifth aspect of the present inventions, pressure compensation is performed by introducing the maximum pressure among the load pressure detected in the respective main operating valves 8, 11, 83 and 84 into the respective pressure compensating valves 9, 12, 85 and 86 shown in FIGS. 1 and 4.

Furthermore, the pressurized oil discharged from the first and second hydraulic pumps 6 and 7 is supplied to the respective hydraulic cylinders 4, 5, 81 and 82.

Here, in cases where a composite operation is performed in which the blade 3 is lifted, tilted and subjected to a pitch operation, the flow rate required by the lifting cylinders 81 and 82 may exceed the maximum flow rate of the pressurized oil that is discharged from one of the hydraulic pump 6 and 7.

In the present invention, in the case of such a composite operation, the pressurized oil that is discharged from both hydraulic pumps 6 and 7 is caused to flow together and is supplied to the lifting cylinders 81 and 82; accordingly, the operating speed of the lifting cylinders 81 and 82 is sufficiently guaranteed, so that the working efficiency can be improved.

Furthermore, since pressure compensation is performed during this composite operation, flow rates that are proportional to the amounts of operation of the tilting/pitch operating lever 50 and operating lever used for the lifting cylinders 81 and 82 can be supplied to the tilting cylinders 4 and 5 and lifting cylinders 81 and 82, so that the operating characteristics of the composite operation can be improved.

DETAILED DESCRIPTION OF THE PREFERRED EMBODIMENTS

Embodiment of the hydraulic control apparatus for work machines provided by the present invention will be described below with reference to the accompanying drawings.

Figure 1:
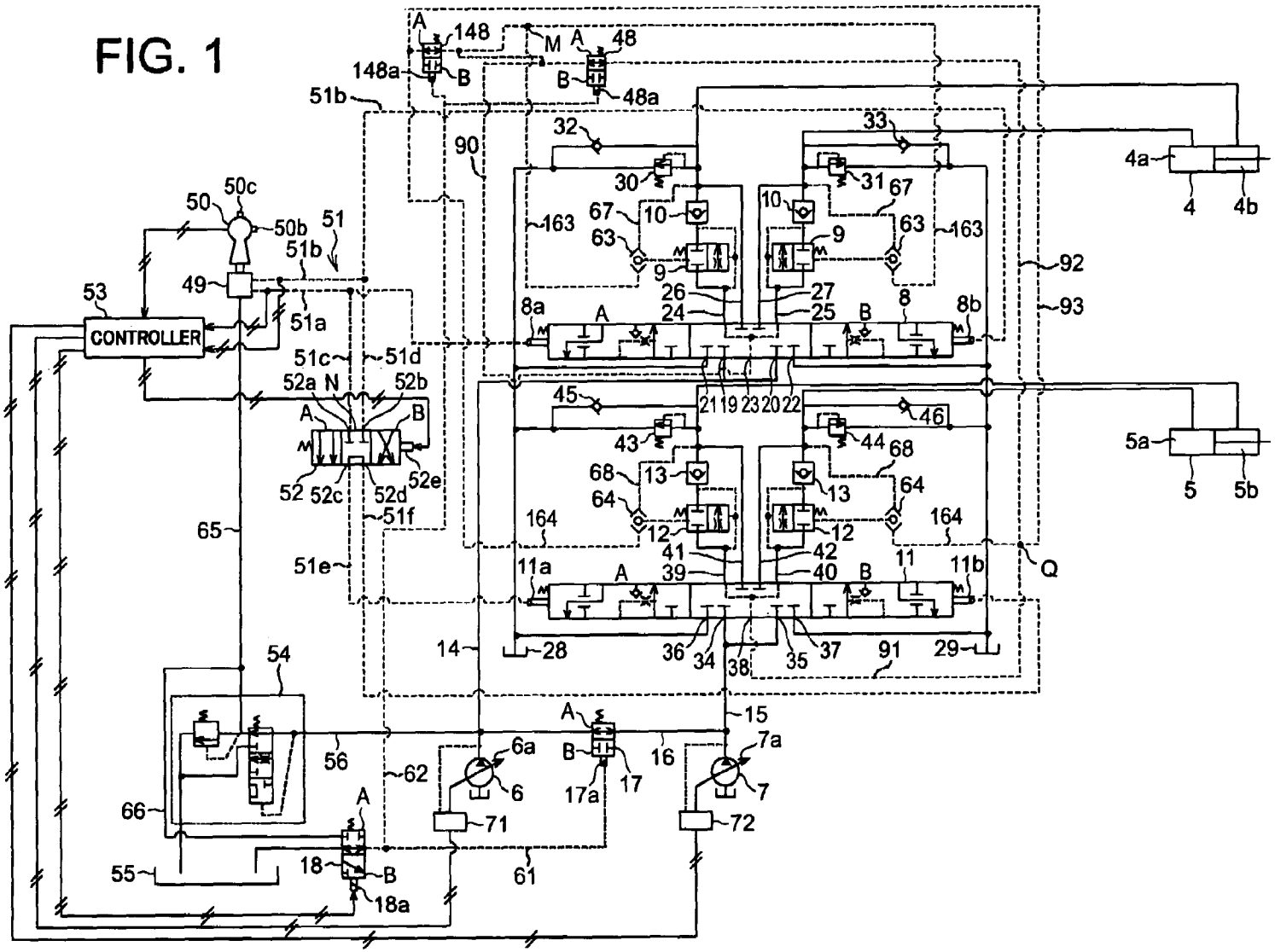
FIG. 1 is a hydraulic circuit diagram showing an embodiment of the hydraulic control apparatus for work machines provided by the present invention.
Figure 2:
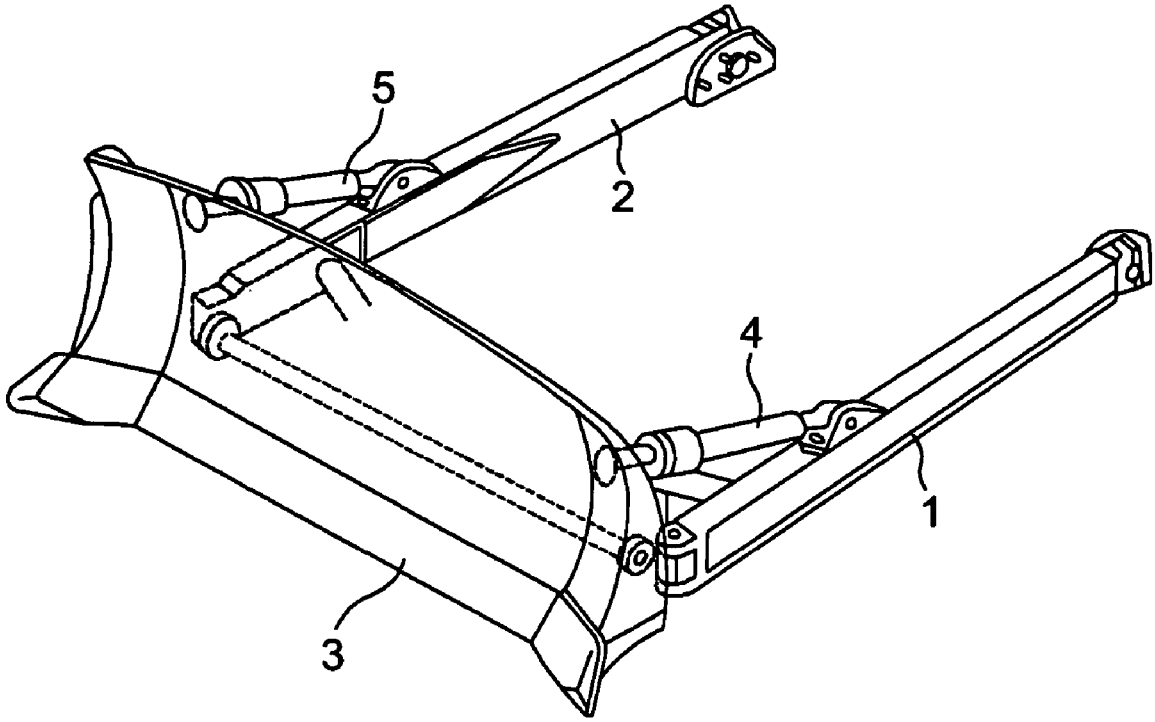
FIG. 2 is perspective view of the peripheral parts of the blade of a bulldozer in the embodiment.

FIG. 1 shows a hydraulic control apparatus for a bulldozer in terms of a hydraulic circuit. FIG. 2 is a perspective view showing the construction of the peripheral parts of the bulldozer blade.

As is shown in FIG. 2, a blade 3 is installed on the front part of the vehicle main body not shown in the figures. Specifically, a pair of left and right straight frames 1 and 2 are supported at one end on the left and right outsides of a track frame not shown in the figures with trunnions as supporting points. The front ends of the respective straight frames 1 and 2 are respectively pivot-supported on the left and right of the back surface of the blade 3.

A pair of left and right tilting cylinders (tilting hydraulic cylinders) 4 and 5 that tilt the blade 3 to the left and right are disposed between the blade 3 and the straight frames 1 and 2. The rods of the tilting cylinders 4 and 5 are connected to the left and right of the back surface of the blade 3, and the cylinder main bodies of the tilting cylinders 4 and 5 are connected to the straight frames 1 and 2. Furthermore, although this is not shown in FIG. 2, a pair of left and right lifting cylinders that raise and lower the blade 3 are disposed on the bulldozer. Furthermore, a pair of left and right ripper lifting cylinders and a pair of left and right ripper tilting cylinders are installed corresponding to a ripper on the rear of the vehicle body.

As is shown in FIG. 1, the left and right tilting cylinders 4 and 5 are driven with two variable displacement hydraulic pumps, i. e., a first hydraulic pump 6 and second hydraulic pump 7, as driving sources.

The first and second hydraulic pumps 6 and 7 are driven by an engine not shown in the figures.

The swash plate 6*a* of the first hydraulic pump 6 is driven by a servomechanism 71. The servomechanism 71 operates in accordance with a control signal (electrical signal, and varies the swash plate 6*a* of the first hydraulic pump 6 to a position that corresponds to this control signal. As a result of the inclined position of the swash plate 6*a* of the first hydraulic pump 6 being varied, the volume (cc/rev) of the first hydraulic pump 6 varies. Similarly, the swash plate 7*a* of the second hydraulic pump 7 is driven by a servomechanism 72. As a result of the inclined position of the swash plate 7*a* of the second hydraulic pump 7 being varied, the volume (cc/rev) of the second hydraulic pump 7 varies.

The discharge port of the first hydraulic pump 6 communicates with a first discharge oil passage 14. The first discharge oil passage 14 communicates with the pump ports 19 and 20 of the first main operating valve 8 used for the left tilting cylinder 4. The reservoir ports 21 and 22 of the first main operating valve 8 respectively communicate with reservoirs 28 and 29.

The first main operating valve 8 is a directional flow control valve that controls the direction and flow rate of the pressurized oil that is supplied to the left tilting cylinder 4.

The cylinder port 24 of the first main operating valve 8 communicates with the head end oil chamber 4*b* of the left tilting cylinder 4 via the first pressure compensating valve 9 and a check valve 10, and the cylinder port 25 of the first main operating valve 8 communicates with the bottom end oil chamber 4*a* of the left tilting cylinder 4 via the first pressure compensating valve 9 and a check valve 10.

The outlet ports of the check valves 10, 10 communicate with the reservoirs 28 and 29 via safety valves 30 and 31 and suction valves 32 and 33.

The auxiliary cylinder ports 26 and 27 of the first main operating valve 8 respectively communicate with the head end oil chamber 4*b* and bottom end oil chamber 4*a* of the left tilting cylinder 4.

The first main operating valve 8 has a valve position A that causes the pump port 20 to communicate with the cylinder port 25 and the auxiliary cylinder port 27, and causes the reservoir port 21 to communicate with the auxiliary cylinder port 26, a neutral position, and a valve position B that causes the pump port 19 to communicate with the cylinder port 24 and auxiliary cylinder port 26, and causes the reservoir port 22 to communicate with the auxiliary cylinder port 27.

Pilot ports 8*a* and 8*b* are installed in the first main operating valve 8. When pilot pressurized oil is supplied to the pilot port 8*a*, the first main operating valve 8 moves to the side of the valve position A. Furthermore, when pilot pressurized oil is supplied to the pilot port 8*b*, the first main operating valve 8 moves to the side of the valve position B.

Meanwhile, the outlet port of the second hydraulic pump 7 communicates with a second discharge oil passage 15. The second discharge oil passage 15 communicates with the pump ports 34 and 35 of the second main operating valve 11 used for the right tilting cylinder 5. The reservoir ports 36 and 37 of the second main operating valve 11 respectively communicate with the reservoirs 28 and 29.

The second main operating valve 11 is a directional flow control valve that controls the direction and flow rate of the pressurized oil that is supplied to the right tilting cylinder 5.

The cylinder port 39 of the second main operating valve 11 communicates with the head end oil chamber 5*b* of the right tilting cylinder 5 via the second pressure compensating valve 12 and a check valve 13, and the cylinder port 40 of the second main operating valve 11 communicates with the bottom end oil chamber 5*a* of the right tilting cylinder 5 via the second pressure compensating valve 12 and a check valve 13.

The outlet ports of the check valves 13, 13 communicate with the reservoirs 28 and 29 via safety valves 43 and 44 and suction valves 45 and 46.

The auxiliary cylinder ports 41 and 42 of the second main operating valve 11 respectively communicate with the head end oil chamber 5*b* and bottom end oil chamber 5*a* of the right tilting cylinder 5.

The second main operating valve 11 has a valve position A that causes the pump port 35 to communicate with the cylinder port 40 and the auxiliary cylinder port 42, and causes the reservoir port 36 to communicate with the auxiliary cylinder port 41, a neutral position, and a valve position B that causes the pump port 34 to communication with the 5 cylinder port 39 and the auxiliary cylinder port 41, and causes the reservoir port 37 to communicate with the auxiliary cylinder port 42.

Pilot ports 11*a* and 11*b* are installed in the second main operating valve 11. When pilot pressurized oil is supplied to the pilot port 11*a*, the second main operating valve 11 moves to the side of the valve position A. Furthermore, when pilot pressurized oil is supplied to the pilot port 11*b*, the second main operating valve 11 moves to the side of the valve position B.

Pilot pressurized oil is supplied to the respective pilot ports 8*a*, 8*b*, 11*a* and 11*b* of the first and second main operating valves 8 and 11 via a pilot pressure signal circuit 51.

Figure 3:
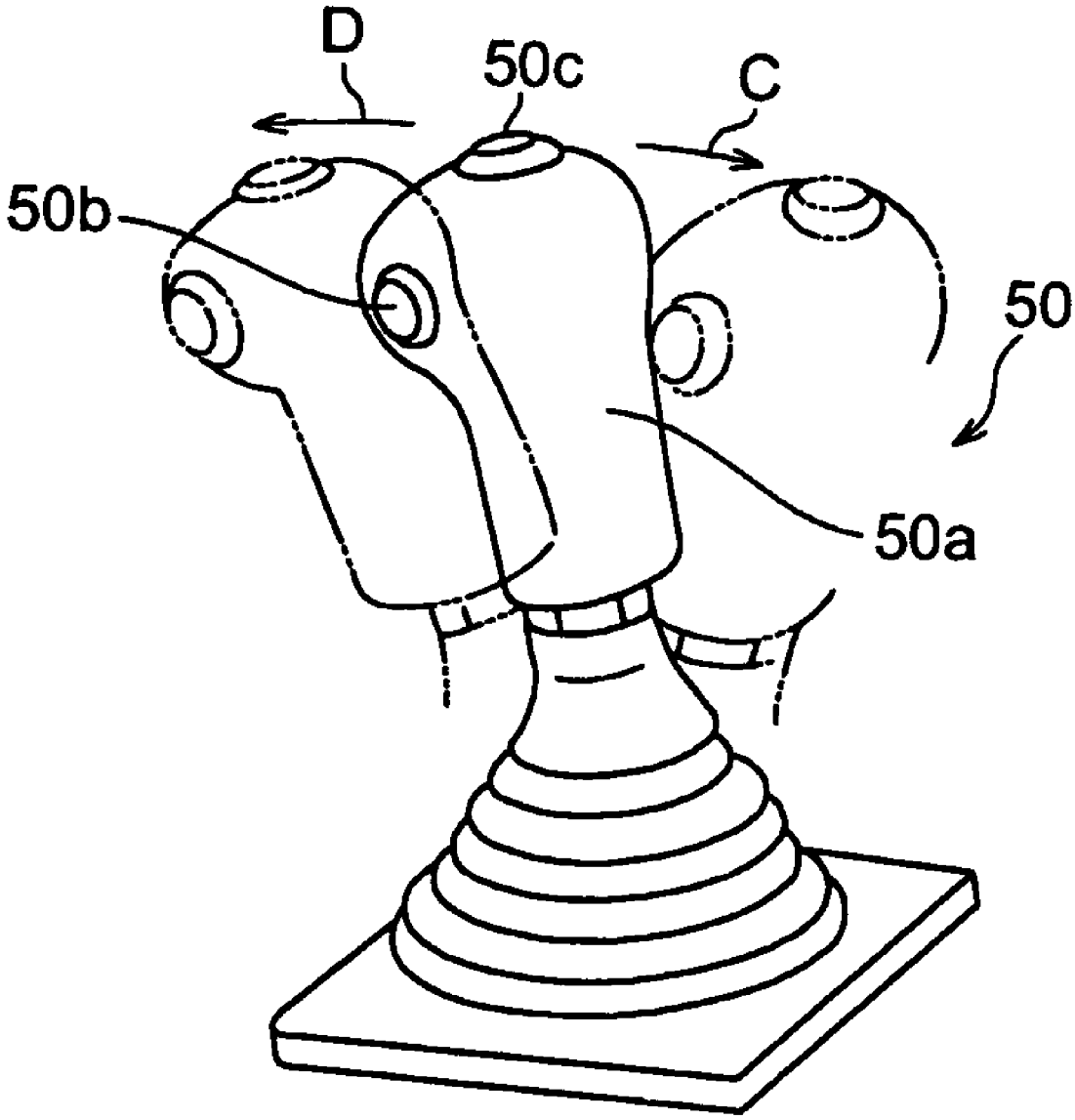
FIG. 3 is a perspective view of the operating lever shown in FIG. 1.

As is shown in FIG. 3, a tilting operating lever 50 that can be operated in the leftward and rightward directions C and D is disposed in the driver's seat of the bulldozer. A pitch dump/pitch back switch 50*b* and a dual tilting switch 50*c* are disposed on the knob 50*a* of the operating lever 50.

A pilot valve 49 is attached to the operating lever 50, and the pilot valve 49 operates in accordance with the operation of the operating lever 50.

A pilot switching valve 52 is interposed in the pilot signal circuit 51, and respective pilot oil passages 51*a* through 51*f* are disposed in this circuit.

Original pressure is supplied to the inlet port of the pilot valve 49 attached to the operating lever 50 via the discharge port of the first hydraulic pump 6, an oil passage 56, an auto pressure reduction valve 54, and an oil passage 65. The outlet port of the pilot valve 49 is caused to communicate with the pilot oil passage 51*a* or 51*b* in accordance with the operating direction of the operating lever 50. The pilot oil passage 5 la communicates with the pilot port 8*a* of the first main operating valve 8, and the pilot oil passage 51*b* communicates with the pilot port 8*b* of the first main operating valve 8. The pilot oil passage 51*a* communicates with pilot oil passage 51*c*, and the pilot passage 51*b* communicates with the pilot passage 51*d*. The pilot oil passages 51*c* and 51*d* respectively communicate with the inlet ports 52*a* and 52*b* of the pilot switching valve 52.

The outlet ports 52*c* and 52*d* of the pilot switching valve 52 respectively communicate with the pilot ports 11*a* and 11*b* of the second main operating valve 11 via the pilot oil passages 52*e* and 52*f*.

The pilot switching valve 52 has a valve position A which causes the inlet port 52*a* to communicate with the outlet port 52*c* and causes the inlet port 52*b* to communicate with the outlet port 52*d*, a neutral position, and a valve position B which causes the inlet port 52*a* to communicate with the outlet port 52*d* and caused the inlet port 52*b* to communicate with the outlet port 52*c*. An electromagnetic solenoid 52*e* is installed in the pilot switching valve 52, and the pilot switching valve 52 operates in accordance with the electrical signal that is applied to the electromagnetic solenoid 52*e* so that the valve position is switched. Electrical signals corresponding to the operating states of the switches 50*b* and 50*c* are applied to the electromagnetic solenoid 52*e* of the pilot switching valve 52.

As will be described later, switching to various operations such as the pitch dumping operation (forward tilting operation) of the blade 3 effected by the driving of both tilting cylinders 4 and 5, the pitch back operation (rearward tilting operation) of the blade 3 effected by the driving of both tilting cylinders 4 and 5, the single tilting operation of the blade 3 effected by the driving of only the left tilting cylinder 4, and the dual tilting operation of the blade 3 effected by the driving of both tilting cylinders 4 and 5, is accomplished in accordance with the operating direction of the operating lever 50 and the operating states of the switches 50*b* and 50*c*.

Signals indicating the operating direction of the operating lever 50 and the operating states of the switches 50*b* and 50*c* are input into the controller 53, and the electrical signals that are to be applied to the electromagnetic solenoid 52*e* of the pilot switching valve 52 are generated on the basis of these input signals, and are output to the electromagnetic solenoid 52*e* of the pilot switching valve 52.

The first discharge oil passage 14 and second discharge oil passage 15 are connected by a communicating oil passage (flow-combining oil passage) 16. A flow-combining/flow-dividing valve 17 is installed in the communicating oil passage 16. The flow-combining/flow-dividing valve 17 is a switching valve which has a flow-combining position A that opens the communicating passage 16 and causes the first discharge oil passage 14 and second discharge oil passage 15 to communicate, and a flow-dividing valve position B which closes the communicating passage 16 and cuts off the communication between the first discharge oil passage 14 and second discharge oil passage 15. The flow-combining/flow-dividing valve 17 performs a switching operation in accordance with hydraulic signals that are applied to the attached pilot valve 17*a* via the pilot oil passage 61. When the hydraulic signal is equal to or greater than a specified pressure, the valve is switched to the flow-dividing position B, and when the hydraulic signal is a pressure (reservoir pressure) that is less than this specified pressure, the valve is switched to the flow-combining position A.

The discharge port of the first hydraulic pump 6 communicates with the inlet port of the flow-combining/flow-dividing switching valve 18 via an oil passage 56, auto pressure reduction valve 54 and oil passage 66. The flow-combining/flow-dividing switching valve 18 causes the reservoir 55 and pilot oil passage 61 to communicate, and is a switching valve which has a flow-combining position A that outputs a hydraulic signal (reservoir pressure) that is smaller than the abovementioned specified pressure to the pilot oil passage 61, and causes the first discharge oil passage 14 and second discharge oil passage 15 to communicate, and a flow-dividing position B that outputs a hydraulic signal that is equal to or greater than the abovementioned specified pressure to the pilot oil passage 61, and cuts off the communication between the first discharge oil passage 14 and second discharge oil passage 15. The flow-combining/flow-dividing switching valve 18 performs a switching operation in accordance with the electrical control signals that are applied to the attached electromagnetic solenoid 18a.

The pilot oil passage 61 branches into a branch pilot oil passage 62, and hydraulic signals are also output into the branch pilot oil passage 62 from the flow-combining/flow-dividing switching valve 18.

First pressure compensating valves 9, 9 that compensate the pressure difference before and after the constriction of the first main operating valve 8 to a specified value are installed in the first main operating valve 8.

Meanwhile, second pressure compensating valves 12, 12 that compensate the pressure difference before and after the constriction of the second main operating valve 11 to a specified value are installed in the second main operating valve 11.

A pilot pressure on the side of the outlet port of the shuttle valve 63 is supplied to the pressure receiving parts of the first pressure compensating valves 9, 9.

One inlet port of the shuttle valve 63 communicates with the outlet port of the check valve 10 via a maintenance pressure introduction oil passage 67, and the other inlet port of the shuttle valve 63 communicates with one input-output port of the flow-combining/flow-dividing valve 148 via a first load pressure introduction oil passage 163.

Meanwhile, a pilot pressure on the side of the outlet port of the shuttle valve 64 is supplied to the pressure receiving parts of the second pressure compensating valves 12, 12.

One inlet port of the shuttle valve 64 communicates with the outlet port of the check valve 13 via a maintenance pressure introduction oil passage 68, and the other inlet port of the shuttle valve 64 communicates with the other input-output port of the flow-combining/flow-dividing valve 148 via a second load pressure introduction oil passage 164.

The cylinder ports 24 and 25 of the first main operating valve 8 communicate with a first load pressure detection port 23, so that the load pressure of left tilting cylinder 4 is detected by the first load pressure detection port 23. The first load pressure detection port 23 communicates with one input-output port of the flow-combining/flow-dividing valve 48 via a first load pressure detection oil passage 190. Furthermore, the first load pressure detection oil passage 90 communicates with the first load pressure introduction passage 163.

Meanwhile, the cylinder ports 39 and 40 of the second main operating valve 11 communicate with a second load pressure detection port 38, and the load pressure of the right tilting cylinder 5 is detected by the second load pressure detection port 38. The second load pressure detection port 38 communicates with the other input-output port of the flow-combining/flow-dividing valve 48 via a second load pressure detection oil passage 91. Furthermore, the second load pressure detection port 38 communicates with the inlet port of the shuttle valve 64 via the second load pressure detection oil passage 91 and second load pressure introduction oil passage 164 (164').

Specifically, the hydraulic circuits inside the flow-combining/flow-dividing valves 48 and 148 conduct pressurized oil from the first load pressure detection port 23 of the first main operating valve 8 to the flow-combining/flow-dividing valve 48 and 148 via the first load pressure detection oil passage 90. Furthermore, the first load pressure detection oil passage 90 branches at the connection point M, and is connected to the left and right shuttle valves 63, 63 via the load pressure introduction passage 163. Furthermore, the hydraulic circuits outside the flow-combining/flow-dividing valves 48 and 148 conduct pressurized oil from the second load pressure detection port 38 of the second main operating valve 11 to the first load pressure detection oil passage 91, and are constructed so as to branch into a three-way channel at the connection point Q. One branch oil passage of the connection Q is the oil passage 92, which is connected to the flow-combining/flow-dividing valve 48. Another branch oil passage is the oil passage 93, which is connected to the flow-combining/flow-dividing valve 148. The remaining branch oil passage is the second load pressure introduction oil passage 164, which is connected to the shuttle valve 64 on the right side of the figure. The oil passage 93 is connected to the second load pressure introduction oil passage 164' by the inlet of the flow-combining/flow-dividing valve 148, and the second load pressure introduction oil passage 164' is connected to the shuttle valve 64 on the left side of the figure.

Furthermore, the flow-combining/flow-dividing valves 48 and 148 are switching valves which have a flow-combining position that introduces the pilot pressurized oil with the highest load pressure among the respective load pressures detected by the first load pressure detection ports 23 and 38 into the first and second load pressure introduction oil passages 163 and 164 (164'), and a flow-dividing position B which respectively introduces the respective load pressures detected by the first load pressure detection ports 23 and 38 into the corresponding first and second load pressure introduction oil passages 163 and 164 (164') via the corresponding first and second load pressure detection oil passages 90 and 91. The flow-combining/flow-dividing valves 48 and 148 perform a switching operation in accordance with hydraulic signals that are applied via the branch pilot oil passage 62 to the attached pilot ports 48*a* and 148a. When the hydraulic signals are equal to or greater than a specified pressure, these valves are switched to the flow-dividing position B, and when the hydraulic signals are a voltage (reservoir voltage) that is smaller than this specified pressure; these valves are switched to the flow-combining position A.

In the controller 53, signals indicating the operating direction of the operating lever 50 and the operating states of the switches 50*b* and 50*c* are input, the electrical control signals that are to be applied to the electromagnetic solenoid 18*a* of the flow-combining/flow-dividing switching valve 18 are generated on the basis of these input signals, and these generated signals are output to the electromagnetic solenoid 18*a* of the flow-combining/flow-dividing switching valve 18.

Furthermore, in the controller 53, signals that indicate the operating direction of the operating lever 50 and the operating states of the switches 50*b* and 50*c* are input, the electrical control signals that are to be applied to the servo valves 71 and 72 are generated on the basis of these input signals, and these generated signals are output to the servo valves 71 and 72, so that the inclined positions of the swash plates 6*a* and 7*a* of the first and second hydraulic pumps 6 and 7 are controlled.

Furthermore, although this is not shown in FIG. 1, the control of the inclined positions of the swash plates 2*a* and 3*a* of the first and second hydraulic pumps 6 and 7 is based on the assumption that this control is accomplished by load sensing control.

Specifically, for example, the load pressure (designated as PL) that is introduced into the first load pressure introduction oil passage 163 is applied to the servomechanism 71 of the first hydraulic pump 6, and the pressure (designated as Pp) of the pressurized oil flowing through the first discharge oil passage 14 is applied to the servomechanism 71 of the first hydraulic pump 6.

Here, the difference between the two pressures Pp−PL is the pressure difference ΔP1 before and after the constriction of the first main operating valve 8. In the servomechanism 71, the inclined position of the swash plate 6*a* of the first hydraulic pump 6 is controlled so that the pressure difference ΔP1 (=Pp−PL) before and after the first main operating valve 8 is maintained at a constant pressure.

In the case of a servomechanism using only a hydraulic circuit that has load sensing control, the pressure difference ΔP before and after the first main operating valve 8 is a constant value; however, in the present embodiment, the hydraulic pressure of a separate system is added to the hydraulic pressure of PL or Pp by the electrical signals from the controller 53, so that the abovementioned before-and-after pressure difference ΔP is made variable.

Similarly, in regard to the side of the second hydraulic pump 7 as well, the load pressure (PL) that is introduced into the second load pressure introduction oil passage 164 is applied to the servomechanism 72 of the second hydraulic pump 7, and the pressure (Pp) of the pressurized oil that flows through the second discharge oil passage 15 is applied to the servomechanism 72 of the second hydraulic pump 7, so that load sensing control is similarly performed.

Next, the relationship between the tilting cylinders 4 and 5 and other tilting cylinders will be described with reference to the hydraulic circuit shown in FIG. 4. Furthermore, for convenience of description, in FIG. 4, the relationship between the left and right lifting cylinders 81 and 82 attached to the blade 3 and the left and right tilting cylinders 4 and 5 will be described, and a description of the pair of left and right ripper lifting cylinders and pair of left and right ripper tilting cylinders corresponding to the ripper installed on the rear of the vehicle body is omitted.

Figure 4:
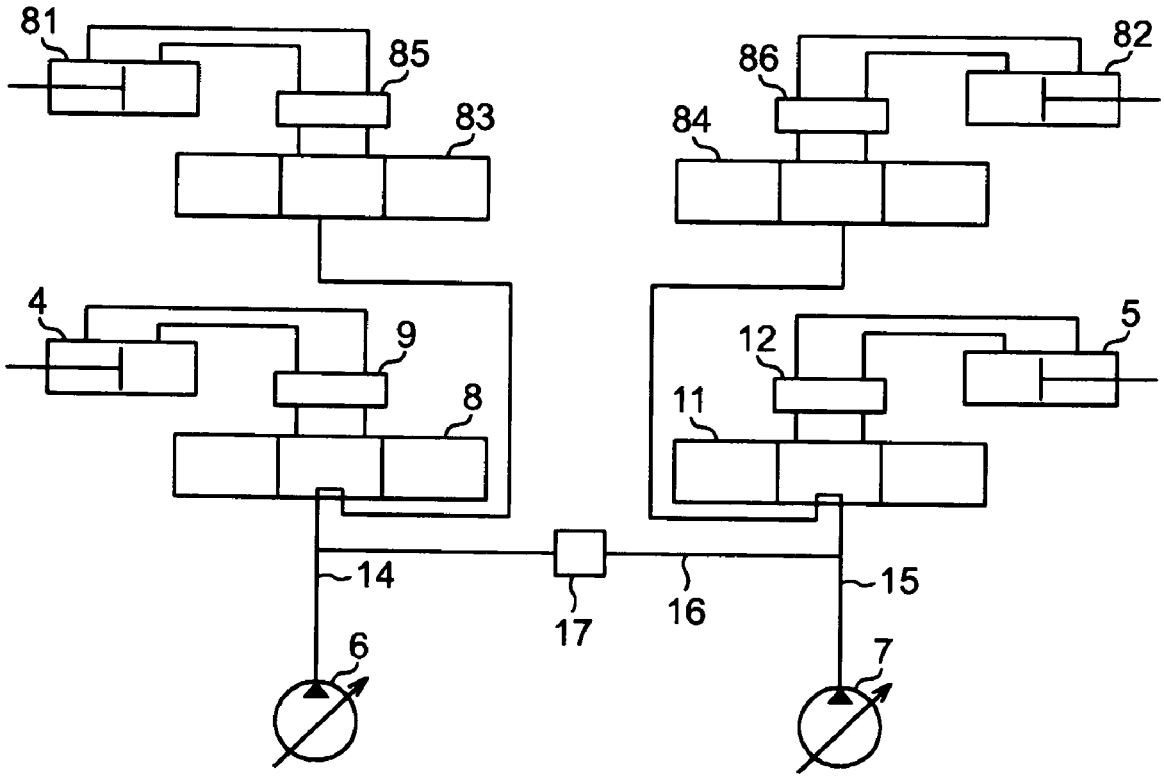
FIG. 4 is a schematic diagram of the hydraulic circuit in a case where lifting hydraulic cylinders, main operating valves and pressure compensating valves are added to FIG. 1.

As is shown in FIG. 4, first and second main operating valves 83 and 84 are installed corresponding to the left and right lifting cylinders 81 and 82 in the same manner as the first and second main operating valves 8 and 11 installed corresponding to the left and right tilting cylinders 4 and 5. Furthermore, first and second pressure compensating valves 85 and 86 are also respectively installed for the first and second main operating valves 83 and 84 in the same manner as the first and second pressure compensating valves 9 and 12 installed corresponding to the first and second main operating valves 8 and 11.

The first main operating valve 8 for the left tilting cylinder and the first main operating valve 83 for the left lifting cylinder are connected in series to the first discharge oil passage 14. Similarly, the second main operating valve 11 for the right tilting cylinder and the second main operating valve 84 for the right lifting cylinder are connected in series to the second discharge oil passage 15.

Furthermore, FIG. 4 is constructed as a series circuit, but working that uses a parallel circuit or tandem circuit is also possible.

The operation of the hydraulic circuit constructed as shown in the abovementioned FIG. 1 and FIG. 4 will be described below.

(Initial State)

When the operator moves the key switch to the engine starting position, a voltage is applied to the controller 53 from the power supply, so that the controller 53 starts, and the engine is started. In the initial state of the controller 53 at the time of starting, an electrical control signal is output to the electromagnetic solenoid 18*a* so that the flow-combining/flow-dividing switching valve 18 is positioned in the flow-combining position A.

When the flow-combining/flow-dividing switching valve 18 is positioned in the flow-combining position A, the respective flow-combining/flow-dividing valves 17, 48 and 148 are positioned in the flow-combining position A, so that pressure compensation is performed.

Specifically, when the flow-combining/flow-dividing valves 48 and 148 are positioned in the flow-combining position A, the first load pressure detection oil passage 90 and second load pressure detection oil passage 91 are caused to communicate with each other, and the first load pressure introduction oil passage 163 and second load pressure introduction oil passage 164 (164') also communicate. Here, assuming that the load pressure detected by the second load pressure detection port 38 of the second main operating valve 11 is higher than the load pressure detected by the first load pressure detection port 23 of the first main operating valve 8, then the maximum load pressure is applied to the pressure receiving part of the first pressure compensating valve 9 via the second load pressure detection port 38, second load pressure detection oil passage 91, flow-combining/flow-dividing valve 48, first load pressure introduction oil passage 163 and shuttle valve 63. As a result, the load pressure on the outlet cylinder port side of the first main operating valve 8 varies from the own load pressure (a load pressure lower than the maximum load pressure) to the maximum load pressure in apparent terms.

Meanwhile, the maximum load pressure is applied to the pressure receiving part of the second pressure compensating valve 12 via the second load pressure detection port 38, second load pressure detection oil passage 91, and second load pressure introduction oil passage 164 (164') and shuttle valve 64. As a result, the load pressure on the outlet cylinder port side of the second main operating valve 11 maintains the own load pressure (maximum load pressure).

When pressure compensation is performed, the pressure difference before and after the constriction of the first main operating valve 8 on the side where the load is light is the same value as the pressure difference before and after the constriction of the second main operating valve 11 on the side where the load is heavy. Accordingly, in the pressure-compensated state, the pressure differences before and after the constructions of the first and second main operating valves 8 and 11 are the same value, so that the load has no effect, and flow rates that are proportional to the degrees of opening of the first and second main operating valves 8 and 11, i. e., to the amount of operation of the operating lever 50, can be supplied to the left and right tilting cylinders 4 and 5.

Thus, a flow-combining state is created in the initial state. Subsequently, a judgment is made as to whether to place the system in a flow-combining state or flow-dividing state in accordance with the operating states of the switches 50*b* and 50*c* disposed on the operating lever 50.

(Pitch Operation)

In cases where it is desired to perform a pitch operation, the operator moves the operating lever 50 in either the leftward direction or rightward direction C or D while pressing the pitch dumping/pitch back switch 50*b* of the operating lever 50.

In the controller 53, as a result of the switch 50*b* being pressed, electrical control signals that are used to place the flow-combining/flow-dividing switching valve 18 and the flow-combining/flow-dividing valves 17, 48 and 148 in the flow-dividing position B are generated, and these electrical control signals are output to the flow-combining/flow-dividing switching valve 18 so that the flow-combining/flow-dividing switching valves 18, the flow-combining/flow-dividing valves 17, 48 and 148 are switched to the flow-dividing position B.

As a result, the communicating oil passage 16 is closed, so that the pressurized oil that is discharged from the first hydraulic pump 6 is discharged only into the first discharge oil passage 14, and the pressurized oil that is discharged from the second hydraulic pump 7 is discharged only into the second discharge oil passage 15.

Furthermore, the first load pressure detection oil passage 90 and second load pressure detection oil passage 91 are cut off, and the firsts load pressure introduction oil passage 163 and second load pressure introduction oil passage 164 (164') are cut off, so that pressure compensation is canceled. Specifically, the own load pressure is applied to the pressure receiving part of the first pressure compensating valve 9 via the first load pressure detection port 23, first load pressure detection oil passage 90, first load pressure introduction oil passage 163 and shuttle valve 63. As a result, the load pressure on the outlet cylinder port side of the first main operating valve 8 maintains the own load pressure.

On the other hand, the own load pressure is applied to the pressure receiving part of the second pressure compensating valve 12 via the second load pressure detection port 38, second load pressure detection oil passage 91, second load pressure introduction oil passage 164, and shuttle valve 64. As a result, the load pressure on the outlet cylinder port side of the second main operating valve 11 maintains the own load pressure.

(Pitch Dumping Operation)

In cases where it is desired to perform a pitch dumping operation, the operator moves the operating lever 50 in the "rightward direction D" while pressing the pitch dumping/pitch back switch 50*b* of the operating lever 50.

When the operating lever 50 is moved in the rightward direction D, the pilot pressure that is discharged from the outlet port of the pilot valve 49 is supplied to the pilot oil passage 51*a*, and acts on the pilot port 8*a* of the first main operating valve 8 via the pilot oil passage 51*a*.

Furthermore, as a result of the switch 50*b* being pressed, an electrical signal is output to the pilot switching valve 52 from the controller 53, so that the pilot switching valve 52 is switched to the A position. Accordingly, the pilot pressure that is discharged from the outlet port of the of the pilot valve 49 acts on the pilot port 11*a* of the second main operating valve 11 via the pilot oil passage 51*a*, pilot oil passage 51*c*, pilot switching valve 52 and pilot port oil passage 51*e*.

Consequently, the first main operating valve 8 is switched to the A position, and the second main operating valve 11 is also switched to the A position. As a result, the pressurized oil that is discharged from the first hydraulic pump 6 passes through the first discharge oil passage 14, pump port 20 of the first main operating valve 8, and cylinder port 25, and is supplied to the bottom end oil chamber 4*a* of the left tilting cylinder 4, so that the left tilting cylinder 4 is operated in the direction of extension. The return pressurized oil from the head end oil chamber 4*b* of the left tilting cylinder 4 is recovered in the reservoir 28 via the auxiliary cylinder port 26 and reservoir port 21 of the first main operating valve 8.

At the same time, the pressurized oil that is discharged from the second hydraulic pump 7 is supplied to the bottom end oil chamber 5*a* of the right tilting cylinder 5 via the second discharge oil passage 15, pump port 35 of the second main operating valve 11, and cylinder port 40, so that the right tilting cylinder 5 is operated in the direction of extension. The return pressurized oil from the head end oil chamber 5*b* of the right tilting cylinder 5 is recovered in the reservoir 28 via the auxiliary cylinder port 41 and reservoir port 36 of the second main operating valve 11. Thus, the left and right tilting cylinders 4 and 5 are simultaneously extended at an equal speed, so that the blade 3 performs a pitch dumping (forward tilting) operation.

(Pitch Back Operation)

In cases where it is desired to perform a pitch back operation, the operator moves the operating lever 50 in the "leftward direction C" while pressing the pitch dumping/pitch back switch 50*b* of the operating lever 50.

When the operating lever 50 is moved in the leftward direction C, the pilot pressure that is discharged from the outlet port of the pilot valve 49 is supplied to the pilot oil passage 51*b*, and acts on the pilot port 8*b* of the first main operating valve 8 via the pilot oil passage 51*b*.

Furthermore, as a result of the switch 50*b* being pressed, an electrical signal is output to the pilot switching valve 52 from the controller 53, so that the pilot switching valve 52 is switched to the A position.

Accordingly, the pilot pressure that is discharged from the outlet port of the pilot valve 49 acts on the pilot port 11*b* of the second main operating valve 11 via the pilot oil passage 51*b*, pilot oil passage 51*d*, pilot switching valve 52, and pilot oil passage 51*f*.

Consequently, the first main operating valve 8 is switched to the B position, and the second main operating valve 11 is also switched to the B position.

As a result, the pressurized oil that is discharged from the first hydraulic pump 6 is supplied to the head end oil chamber 4*b* of the left tilting cylinder 4 via the first discharge oil passage 14, pump port 19 of the first main operating valve 8 and cylinder port 24, so that the left tilting cylinder 4 is operated in the direction of retraction. The return pressurized oil from the bottom end oil chamber 4*a* of the left tilting cylinder 4 is recovered in the reservoir 29 via the auxiliary cylinder port 27 and reservoir port 22 of the first main operating valve 8.

At the same time, the pressurized oil that is discharged from the second hydraulic pump 7 is supplied to the head end oil chamber 5*b* of the right tilting cylinder 5 via the second discharge oil passage 15, pump port 34 of the second main operating valve 11, and cylinder port 39, so that the right tilting cylinder 34 is operated in the direction of retraction. The return pressurized oil from the bottom end oil chamber 5*a* of the right tilting cylinder 5 is recovered in the reservoir 29 via the auxiliary cylinder port 42 and reservoir port 37 of the second main operating valve 11. Thus, the respective left and right tilting cylinders 4 and 5 are simultaneously retracted at an equal speed, so that the blade 3 performed a pitch back (rearward tilting) operation.

Thus, in the case of a pitch operation, pressure compensation is canceled, and pressurized oil is independently supplied from the first hydraulic pump 6 and second hydraulic pump 7 to the left and right tilting cylinders 4 and 5.

Accordingly, the inconvenience of a deviation in pressure compensation being generated by the performance of pressure compensation during a pitch operation in cases where the difference in the load pressures of the left and right tilting cylinders 4 and 5 is large, so that the same flow rate cannot be supplied to the left and right tilting cylinders 4 and 5, thus making it impossible to operate the left and right tilting cylinders 4 and 5 at a uniform operating speed, can be avoided. As a result, a state in which the piston rods of the left and right tilting cylinders 4 and 5 do not reach the same stroke position during a pitch operation, so that the blade 3 tilts, can be prevented.

(Dual Tilting Operation)

In cases where it is desired to perform a dual tilting operation, the operator moves the operating lever 50 in either the leftward or rightward direction C or D while pressing the dual tilting switch 50*c* of the operating lever 50.

As a result of the switch 50*c* being pressed, electrical control signals that are used to place the flow-combining/flow-dividing switching valve 18 and flow-combining/flow-dividing valves 17, 48 and 148 in the flow-dividing position B are generated by the controller 53, and these electrical control signals are output to the flow-combining/flow-dividing switching valve 18 so that the flow-combining/flow-dividing switching valves the flow-combining/flow-dividing valves 17, 48 and 148 are switched to the flow-dividing position B.

As a result, the communicating oil passage 16 is closed, so that the pressurized oil that is discharged from the first hydraulic pump 6 is discharged only into the first discharge oil passage 14, and the pressurized oil that is discharged from the second hydraulic pump 7 is discharged only into the second discharge oil passage 15.

Furthermore, the first load pressure detection oil passage 90 and second load pressure detection oil passage 91 are cut off, and the first load pressure introduction oil passage 163 and second load pressure introduction oil passage 164 are cut off, so that pressure compensation is canceled. Specifically, the own load pressure is applied to the pressure receiving part of the first pressure compensating valve 9 via the first load pressure detection port 23, first load pressure detection oil passage 90, first load pressure introduction oil passage 163 and shuttle valve 63. As a result, the load pressure on the outlet cylinder port side of the first main operating valve 8 maintains the own load pressure.

Meanwhile, the own load pressure is applied to the pressure receiving part of the second pressure compensating valve 12 via the second load pressure detection port 38, the second load pressure detection oil passage 91, the second load pressure introduction oil passage 164 and the shuttle valve 64. As a result, the load pressure on the outlet cylinder port side of the second main operating valve 11 maintains the own load pressure.

(Right Dual Tilting Operation)

In cases where it is desired to perform a right dual tilting operation, the operator moves the operating lever 50 in the "rightward direction D" while pressing the dual tilting switch 50*c* of the operating lever 50.

When the operating lever 50 is moved in the rightward direction D, the pilot pressure that is discharged from the outlet port of the pilot valve 49 is supplied to the pilot oil passage 51*a*, and acts on the pilot port 8*a* of the first main operating valve 8 via the pilot oil passage 51*a*.

Furthermore, as a result of the switch 50*c* being pressed, an electrical signal is output to the pilot switching valve 52 from the controller 53, so that the pilot switching valve 52 is switched to the B position.

Accordingly, the pilot pressure that is discharged from the outlet port of the pilot valve 49 acts on the pilot port 11*b* of the second main operating valve 11 via the pilot oil passage 51*a*, pilot oil passage 51*c*, pilot switching valve 52 and pilot oil passage 51*f*.

Consequently, the first main operating valve 8 is switched to the A position, and the second main operating valve 11 is switched to the B position.

As a result, the pressurized oil that is discharged from the first hydraulic pump 6 is supplied to the bottom end oil chamber 4*a* of the left tilting cylinder 4 via the first discharge oil passage 14, pump port 20 of the first main operating valve 8, and cylinder port 25, so that the left tilting cylinder 4 is operated in the direction of extension. The return pressurized oil from the head end oil chamber 4*b* of the left tilting cylinder 4 is recovered in the reservoir 28 via the auxiliary cylinder port 26 and reservoir port 21 of the first main operating valve 8.

At the same time, the pressurized oil that is discharged from the second hydraulic pump 7 is supplied to the head end oil chamber 5*b* of the right tilting cylinder 5 via the second discharge oil passage 15, pump port 34 of the second main operating valve 11, and cylinder port 39, so that the right tilting cylinder 5 is operated in the direction of retraction. The return pressurized oil from the bottom end oil chamber 5*a* of the right tilting cylinder 5 is recovered in the reservoir 29 via the auxiliary cylinder port 42 and reservoir port 37 of the second main operating valve 11.

Thus, an extension operation of the left tilting cylinder 4 and a retraction operation of the right tilting cylinder 5 are simultaneously performed, so that the blade 3 performs a right dual tilting operation at a high speed (substantially twice the speed of a single tilting operation).

(Left Dual Tilting Operation)

In cases where it is desired to perform a left dual tilting operation, the operator moves the operating lever 50 in the "leftward direction C" while pressing the dual tilting switch 50*c* of the operating lever 50.

When the operating lever 503 is moved in the leftward direction C, the pilot pressure that is discharged from the outlet port of the pilot valve 49 is supplied to the pilot oil passage 51*b*, and acts on the pilot port 8*b* of the first main operating valve 8 via the pilot oil passage 51*b*.

Furthermore, as a result of the switch 50*c* being pressed, an electrical signal is output to the pilot switching valve 52 from the controller 53, so that the pilot switching valve 52 is switched to the B position.

Accordingly, the pilot pressure that is discharged from the outlet port of the pilot valve 49 acts on the pilot port 11*a* of the second main operating valve 11 via the pilot oil passage 51*b*, pilot oil passage 51*d*, pilot switching valve 52, and pilot oil passage 51*e*.

Consequently, the first main operating valve 8 is switched to the B position, and the second main operating valve 11 is switched to the A position.

As a result, the pressurized oil that is discharged from the first hydraulic pump 6 is supplied to the head end oil chamber 4*b* of the left tilting cylinder 4 via the first discharge oil passage 14, pump port 19 of the first main operating valve 8, and cylinder port 24, so that the left tilting cylinder 4 is operated in the direction of retraction. The return pressurized oil from the bottom end oil chamber 4*a* of the left tilting cylinder 4 is recovered in the reservoir 29 via the auxiliary cylinder port 27 and reservoir port 22 of the first main operating valve 8.

At the same time, the pressurized oil that is discharged from the second hydraulic pump 7 is supplied to the bottom end oil chamber 5*a* of the right tilting cylinder 5 via the second discharge oil passage 15, pump port 35 of the second main operating valve 11, and cylinder port 40, so that the right tilting cylinder 5 is operated in the direction of extension. The return pressurized oil from the head end oil chamber 5*b* of the right tilting cylinder 5 is recovered in the reservoir 28 via the cylinder port 41 and reservoir port 36 of the second main operating valve 11.

Thus, a retraction operation of the left tilting cylinder 4 and extension operation of the right tilting cylinder 5 are simultaneously performed, so that the blade 3 performs a left dual tilting operation at a high speed (substantially twice the speed of a single tilting operation).

Thus, during a dual tilting operation, pressure compensation is canceled, so that pressurized oil is independently supplied to the left and right tilting cylinders 4 and 5 from the first hydraulic pump 6 and second hydraulic pump 7.

Accordingly, the flow rates of the pressurized oil supplied to the left and right tilting cylinders 4 and 5 can be independently adjusted by means of the servomechanisms 71 and 72.

In the controller 53, as a result of the dual tilting switch 50*c* being pressed, electrical control signals that are used to set the stroke amounts of the tilting cylinders 4 and 5 at the same amount P during retraction and during extension are output to the servomechanisms 71 and 72, and the swash angles of the swash plates 6*a* and 7*a* of the first and second hydraulic pumps 6 and 7 are controlled so that the flow rates that are supplied to the respective tilting cylinders 4 and 5 are adjusted.

Figure 5A:
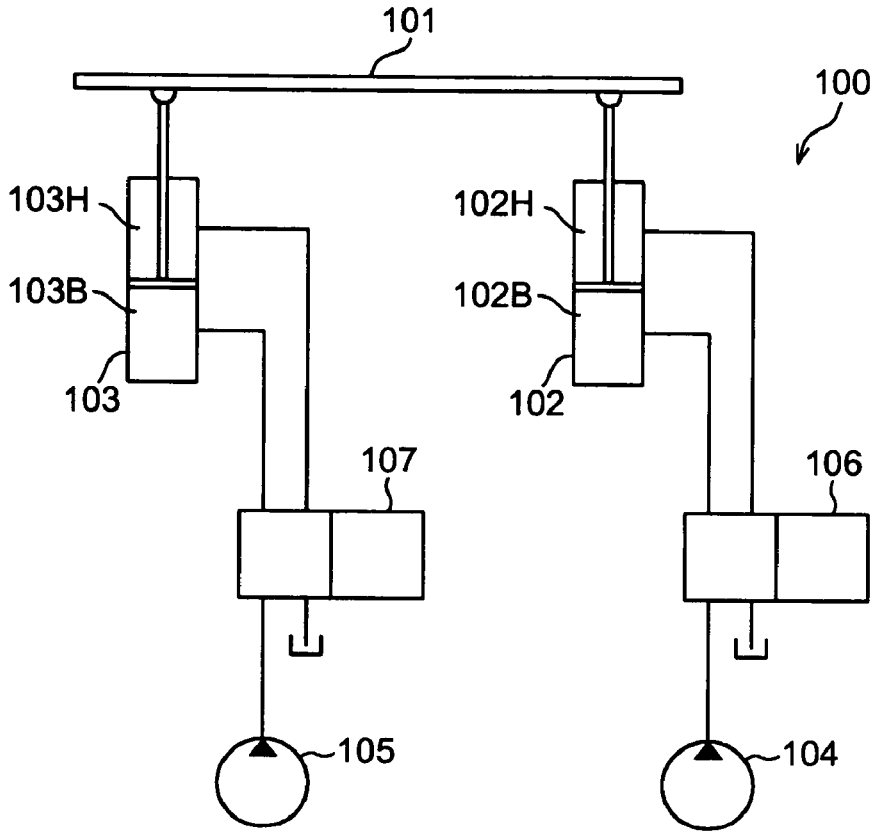
PRIOR ART FIG. 5A
FIGS. 5A and 5B are respectively a conventional hydraulic circuit diagram, and a diagram showing the variation in the stroke positions of the hydraulic cylinders.
Figure 5B:
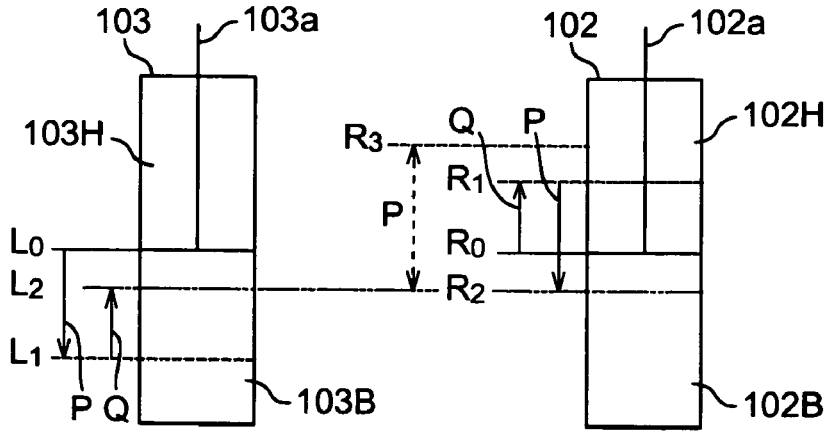
Figure 6:
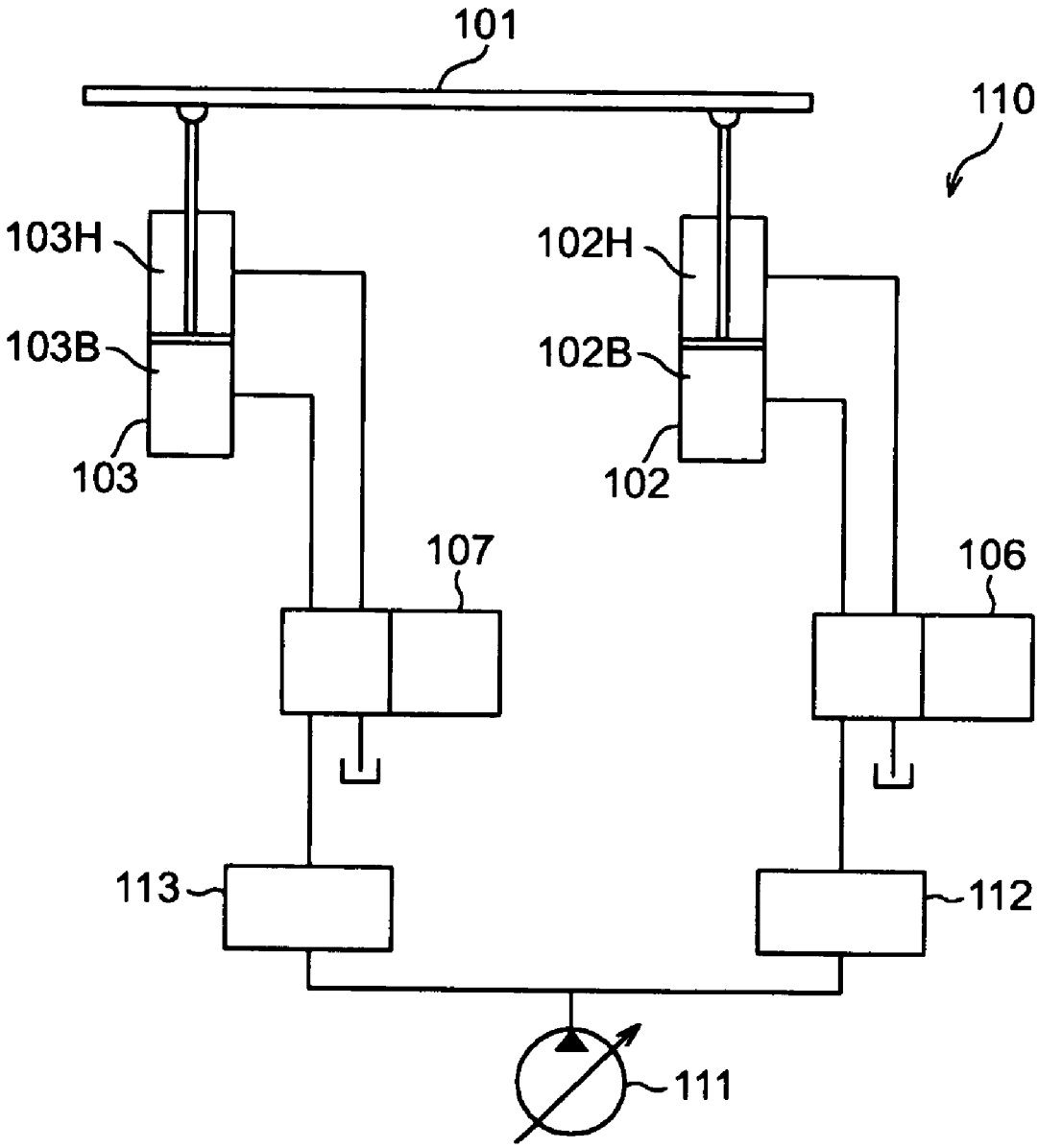
PRIOR ART FIG. 6
FIG. 6 is a conventional hydraulic circuit diagram.

Referring now to the abovementioned FIG. 5B as well, in the case of the left tilting cylinder 4 (tilting cylinder 103 in FIG. 5B), during retraction, pressurized oil at a specified flow rate QH is supplied to the head end oil chamber 4*b* (head end oil chamber 103H in FIG. 5B), so that the tilting cylinder moves in the direction of retraction by a stroke P from the initial position L0, and reaches the stroke position L1; then, during the subsequent extension, pressurized oil at a flow rate QB that is larger than the flow rate QH during retraction is supplied to the bottom end oil chamber 4*a* (bottom end oil chamber 103B in FIG. 5B), so that the tilting cylinder moves by the same stroke P in the direction of extension from the stroke position L1, and returns to the original initial position L0.

The amount of oil required in order to obtain the same stroke during retraction and extension (corresponding to the abovementioned QH and QB) is determined by the volumetric ratio of the head side and bottom side of the cylinder. Specifically, the reason for this is as follows: namely, in FIG. 5B, since the cylinder rod 103*a* or 102*a* is a rod that actually has a volume, if QH=QB, then a difference is generated in the movement stroke.

Accordingly, on the head side and bottom side, if an amount of oil that is proportional to the effective pressure receiving area that receives the hydraulic pressure is supplied to the cylinder during retraction and extension, the strokes during retraction and extension can be made equal.

In the present embodiment, the system is constructed so that this pressure receiving area ratio is stored beforehand in the controller 53, and the swash angles of the swash plates 6*a* and 7*a* of the first and second hydraulic pump 6 and 7 are controlled so that an amount of oil that is reduced according to the stored pressure receiving area ratio is supplied to the head side during retraction (with the amount of pressurized oil supplied during extension (supply of pressurized oil to the bottom side) taken as 1).

Meanwhile, in the case of the right tilting cylinder 5 (tilting cylinder 102 in FIG. 5B, during extension, pressurized oil at a specified flow rate of QB is supplied to the bottom end oil chamber 5*a* (bottom end oil chamber 102B in FIG. 5B), so that this tilting cylinder moves by a stroke of P in the direction of extension from the initial position R0, and reaches the stroke position R3. Then, during the subsequent retraction, pressurized oil at a flow rate of QH that is smaller than the flow rate QB during extension is supplied to the head end oil chamber 5*b* (head end oil chamber 102H in FIG. 5B, so that the tilting cylinder moves by the same stroke P in the direction of retraction from the stroke position R3, and returns to the original initial position R0.

As a result, the stroke positions of the left and right tilting cylinders 4 and 5 maintain the original initial positions without being shifted toward the pitch back side from the initial positions L0 and R0 as a result of a single dual tilting operation. In other words, a dual tilting operation can be performed without causing the blade 3 to fall over on the pitch back side. Furthermore, even if a dual tilting operation is performed a multiple number of times, the piston rods do not reach the stroke end on pitch back side of the blade 3, i. e., in the direction of retraction.

Furthermore, since pressure compensation is canceled, the inconvenience of a deviation in pressure compensation being generated in cases where the difference between the load pressures of the left and right tilting cylinders 4 and 5 is large during a dual tilting operation, so that the same flow rates cannot be supplied to the left and right tilting cylinders 4 and 5, thus making it impossible for the left and right tilting cylinders 4 and 5 to operate at a uniform speed, can be avoided. As a result, a state in which the piston rods of the left and right tilting cylinders 4 and 5 do not return to the initial positions in a dual tilting operation, so that the blade 3 is tilted, can be prevented.

(Single Tilting Operation)

In cases where it is desired to perform a single tilting operation, the operating lever 50 is moved in either the leftward or rightward direction C or D without pressing either the pitch dumping/pitch back switch 50*b* or dual tilting switch 50*c* of the operating lever 50.

If neither of the switches 50*b* nor 50*c* is pressed, then electrical control signals that are sued to place the flow-combining/flow-dividing switching valve 18 and flow-combining/flow-dividing valves 17, 48 and 148 in the flow-combining position A are generated in the controller 53, and these electrical control signals are output to the flow-combining/flow-dividing switching valve 18 so that the flow-combining/flow-dividing switching valve 18 and flow-combining/flow-dividing valves 17, 48 and 148 are switched to the flow-combining position A.

As a result, the communicating oil passage 16 is closed, so that the pressurized oil that is discharged from the first and second hydraulic pumps 6 and 7 is discharged into the first discharge oil passage 14, and the pressurized oil that is discharged from the first and second hydraulic pumps 6 and 7 is discharged into the second discharge oil passage 15.

Furthermore, the first load pressure detection oil passage 90 and second load pressure detection oil passage 91 are caused to communicate with each other, and the first load pressure introduction oil passage 163 and second load pressure introduction oil passage 164 (164') also communicate, so that pressure compensation is performed. Specifically, if the load pressure that is detected by the second load pressure detection port 38 of the second main operating valve 11 is higher than the load pressure that is detected by the first load pressure detection port 23 of the first main operating valve 8, then the maximum load pressure is applied to the pressure receiving part of the first pressure compensating valve 9 via the second load pressure detection port 38, second load pressure detection oil passage 91, flow-combining/flow-dividing valve 48, first load pressure introduction oil passage 163 and shuttle valve 63. As a result, the load pressure on the outlet cylinder port side of the first main operating valve 8 varies from the own load pressure (a load pressure that is lower than the maximum load pressure) to the maximum load pressure in apparent terms.

Meanwhile, the maximum load pressure is applied to the pressure receiving part of the second pressure compensating valve 12 via the second load pressure detection port 38, second load pressure detection oil passage 91, second load pressure introduction oil passage 164 and shuttle valve 64. As a result, the load pressure on the outlet cylinder port side of the second main operating valve 11 maintains the own load pressure (maximum load pressure).

(Right Single Tilting Operation)

In cases where it is desired to perform a right single tilting operation, the operating lever 50 is moved in the "rightward direction D" without pressing either the pitch dumping/pitch back switch 50*b* or dual tilting switch 50*c* of the operating lever 50.

When the operating lever 50 is moved in the rightward direction, the pilot pressure that is discharged from the outlet port of the pilot valve 49 is supplied to the pilot oil passage 51*a*, and acts on the pilot port 8*a* of the first main operating valve 8 via the pilot oil passage 51*a*.

Furthermore, when the switches 50*b*, 50*b* are not pressed, an electrical signal is output to the pilot switching valve 52 from the controller 53, so that the pilot switching valve 52 is held in the neutral position N.

Accordingly, no pilot pressure is supplied to the pilot port 8*a* or 8*b* of the second main operating valve 11.

Consequently, the first main operating valve 8 is switched to the A position, and the second main operating valve 11 is held in the N position.

As a result, the pressurized oil that is discharged from the first and second hydraulic pump 6 and 7 is supplied to the bottom end oil chamber 4*a* of the left tilting cylinder 4 via the first discharge oil passage 14, pump port 20 of the first main operating valve 8, and cylinder port 25, and left tilting cylinder 4 moves in the direction of extension. The return pressurized oil from the head end oil chamber 4*b* of the left tilting cylinder 4 is recovered in the reservoir 28 via the auxiliary cylinder port 26 and reservoir port 21 of the first main operating valve 8.

Meanwhile, since the second main operating valve 11 is in the neutral position, pressurized oil is not supplied to the right tilting cylinder 5, so that the operation of the right tilting cylinder 5 is stopped.

Thus, in a state in which the right tilting cylinder 5 is stopped, only an extension operation of the left tilting cylinder 4 is performed, so that the blade 3 performs a right single tilting operation at the ordinary speed (low speed).

(Left Single Tilting Operation)

In cases where it is desired to perform a left single tilting operation, the operating lever 50 is moved in the "leftward direction C" without pressing either the pitch dumping/pitch back switch 50*b* or dual tilting switch 50*c* of the operating lever 50.

When the operating lever 50 is moved in the leftward direction C, the pilot pressure that is discharged from the outlet port of the pilot valve 49 is supplied to the pilot oil passage 51*b*, and acts on the pilot port 8*b* of the first main operating valve 8 via the pilot oil passage 51*b*.

Furthermore, if neither the switches 50*b*, 50*b* are not pressed, an electrical signal is output to the pilot switching valve 52 from the controller 53, so that the pilot switching valve 52 is held in the neutral position N.

Accordingly, no pilot pressure is supplied to the pilot port 8*a* or 8*b* of the second main operating valve 11.

Consequently, the first main operating valve 8 is switched to the B position, and the second main operating valve 11 maintains the neutral position.

As a result, the pressurized oil that is discharged from the first and second hydraulic pumps 6 and 7 is supplied to the head end oil chamber 4*b* of the left tilting cylinder 4 via the first discharge oil passage 14, the pump port 19 of the first main operating valve 8, and the cylinder port 24, so that the left tilting cylinder 4 is operated in the direction of retraction. The return pressurized oil from the bottom end oil chamber 4*a* of the left tilting cylinder 4 is recovered in the reservoir 29 via the auxiliary cylinder port 27 and reservoir port 22 of the first main operating valve 8.

Meanwhile, since the second main operating valve 11 is in the neutral position, no pressurized oil is supplied to the right tilting cylinder 5, so that the operation of the right tilting cylinder 5 is stopped.

Thus, in a state in which the right tilting cylinder 5 is stopped, only a retraction operation of the left tilting cylinder 4 is performed, so that the blade 3 performs a left single tilting operation at the ordinary speed (low speed).

(Composite Operation)

In cases where it is desired to cause the blade 3 to perform a tilting operation or pitch operation while lifting, the operator operates the operating lever 50 used for tilting/pitch operations, and also operates the operating lever used for the lifting cylinders 81 and 82.

When a signal indicating that the operating lever 50 used for tilting/pitch operations and a signal indicating that the operating lever used for the lifting cylinders has been operated are input into the controller 53, and it is judged that a tilting operation (single tilting operation, dual tilting operation) or pitch operation and a lifting operation are being performed at the same time, electrical control signals that are used to place the flow-combining/flow-dividing switching valve 18 and flow-combining/flow-dividing valves 17, 48 and 148 in the flow-combining position A are generated, and these electrical control signals are output to the flow-combining/flow-dividing switching valve 18 so that the flow-combining/flow-dividing switching valve 18 and flow-combining/flow-dividing valves 17, 48 and 148 are switched to the flow-combining position A.

As a result, the maximum pressure among the load pressures detected by the respective main operating valves 8, 11, 83 and 84 is introduced into the respective pressure compensating valves 9, 12, 85 and 86, so that pressure compensation is performed.

Furthermore, the pressurized oil that is discharged from the first and second hydraulic pumps 6 and 7 is supplied to the respective hydraulic cylinders 4, 5, 81 and 82.

Here, in the case of a composite operation in which the blade 3 is caused to perform a tilting operation of pitch operation while lifting, the flow rate required by the lifting cylinders 81 and 82 may in some cases exceed the maximum flow rate of the pressurized oil that is discharged from either one of the hydraulic pumps 6 and 7. In the present embodiment, the pressurized oil that is discharged from both hydraulic pumps 6 and 7 is caused to flow together in the case of a composite operation, and is supplied to the lifting cylinders 81 and 82; accordingly, the operating speeds of the lifting cylinders 81 and 82 can be sufficiently maintained, and the working efficiency can be improved.

Furthermore, since pressure compensation is performed in the case of a composite operation, flow rates that are proportional to the amounts of operation of the operating lever 50 used for tilting/pitch operations and the operating lever used for the lifting cylinders 81 and 82 can be supplied to the tilting cylinders 4 and 5 and lifting cylinders 81 and 82 regardless of differences in the magnitude of the load, so that the operating characteristics during a composite operation can be improved.

The present invention was described above in terms of several limited number of embodiments; however, other embodiment obtained by a person skilled in the art receiving the benefit of the disclosure of the present invention are also included in the scope of the technical spirit of the present invention.

What is claimed is:

1. A hydraulic control apparatus for work machines comprising:

a blade that is attached to a vehicle main body so that the blade is capable of a tilting operation;

first and second variable displacement hydraulic pumps;

left and right tilting hydraulic cylinders that are attached to left and right of the blade, and that are driven by a supply of pressurized oil that is discharged from the first and second variable displacement hydraulic pumps;

first and second main operating valves in which direction and flow rate of the pressurized oil that is supplied to the left and right tilting hydraulic cylinders are controlled;

first and second discharge oil passages that connect discharge ports of the first and second variable displacement hydraulic pumps and the first and second main operating valves;

first and second pressure compensating valves that compensate differential pressures before and after the first and second main operating valves to specified values;

a first flow-combining/flow-dividing valve that switches between a flow-combining position that causes communication between the first discharge oil passage and second discharge oil passage, and a flow-dividing position that cuts off the communication between the first discharge oil passage and the second discharge oil passage; and control means for controlling the switching of the flow-combining/flow-dividing valve so that a switching action is performed in which the flow-combining/flow-dividing valve is switched from the flow-combining position to the flow-dividing position in cases where it is judged that a dual tilting operation is to be performed in which pressurized oil is supplied to a bottom end oil chamber of one of the tilting hydraulic cylinders among the left and right tilting hydraulic cylinders, and pressurized oil is supplied to a head end oil chamber of the other tilting hydraulic cylinder.

2. The hydraulic control apparatus for work machines according to claim 1, further comprising flow rates control means for controlling the flow rates that are supplied to the left and right tilting hydraulic cylinders so that the stroke on an extension side and stroke on a retraction side of the left and right tilting hydraulic cylinders are the same during a dual tilting operation.

3. The hydraulic control apparatus for work machines according to claim 1, further comprising hydraulic actuators for a work implement that are driven by the supply of pressurized oil that is discharged from the first and second variable displacement hydraulic pumps, other than the left and right tilting hydraulic cylinders, wherein the switching control means control the flow-combining/flow-dividing valve so that an operation is performed in which the flow-combining/flow-dividing valve is switched from the flow-dividing position to the flow-combining position in cases where it is judged that the hydraulic actuators for a work implement are to be driven simultaneously with the left and right tilting hydraulic cylinders.

4. A hydraulic control apparatus for work machines comprising:

a blade that is attached to the vehicle main body so that the blade is capable of a tilting operation;

first and second variable displacement hydraulic pumps;

left and right tilting hydraulic cylinders that are attached to left and right of the blade, and that are driven by a supply of pressurized oil that is discharged from the first and second variable displacement hydraulic pumps;

first and second main operating valves in which direction and flow rate of the pressurized oil that is supplied to the left and right tilting hydraulic cylinders are controlled;

first and second discharge oil passages that connect discharge ports of the first and second variable displacement hydraulic pumps and the first and second main operating valves;

first and second pressure compensating valves that compensate differential pressures before and after the first and second main operating valves to specified values;

a first flow-combining/flow-dividing valve which switches between a flow-combining position that causes communication between the first discharge oil passage and second discharge oil passage, and a flow-dividing position that cuts off the communication between the first discharge oil passage and the second discharge oil passage; and control means for controlling switching of the flow-combining/flow-dividing valve so that a switching action is performed in which the flow-combining/flow-dividing valve is switched from the flow-combining position to the flow-dividing position in cases where it is judged that a pitch operation is to be performed in which pressurized oil is supplied to one of the oil chambers among a bottom end oil chamber and a head end oil chamber for the left and right tilting hydraulic cylinders.

5. The hydraulic control apparatus for work machines according to claim 4, further comprising hydraulic actuators for a work implement that are driven by the supply of pressurized oil that is discharged from the first and second variable displacement hydraulic pumps, other than the left and right tilting hydraulic cylinders, wherein the switching control means control the flow-combining/flow-dividing valve so that an operation is performed in which the flow-combining/flow-dividing valve is switched from the flow-dividing position to the flow-combining position in cases where it is judged that the hydraulic actuators for a work implement are to be driven simultaneously with the left and right tilting hydraulic cylinders.

* * * * *